United States Patent [19]

Moore et al.

[11] Patent Number: 4,759,506

[45] Date of Patent: Jul. 26, 1988

[54] DAMPENER NOZZLE FOR PRINTING PRESSES

[75] Inventors: Andrew L. Moore, Chicago; Thaddeus A. Niemiro, Lisle, both of Ill.

[73] Assignee: Rockwell International Corporation, Pittsburgh, Pa.

[21] Appl. No.: 48,855

[22] Filed: May 12, 1987

[51] Int. Cl.[4] ..... B05B 7/08; B41L 25/06

[52] U.S. Cl. ..... 239/426; 239/524; 101/147

[58] Field of Search ..... 239/426, 433, 518, 524, 239/434; 101/147 X

[56] References Cited

U.S. PATENT DOCUMENTS 883,144 3/1908 Mikorey ..... 239/426

*Primary Examiner*—Andres Kashnikow
*Assistant Examiner*—Karen B. Merritt

[57] ABSTRACT

An improved spray nozzle for supplying dampening fluid to a printing press is made of modular parts joined together and formed so that air and dampening fluids flow through the body of the nozzles, exit through outlet orifices in directions substantially perpendicular with respect to each other, and then impinge against a deflector plate located between two of the body modules so that fluids join while traveling in substantially parallel directions to produce a spray which is widely dispersed in the direction while being narrowly dispersed in a second direction.

4 Claims, 2 Drawing Sheets

DAMPENER NOZZLE FOR PRINTING PRESSES

BACKGROUND OF THE INVENTION

1. Field of the Invention

This invention relates to an improved nozzle for applying dampening fluid to the dampening rolls of lithographic printing presses. Specifically, it provides an improved means for obtaining a widely dispersed yet thin almost laminar spray in which droplet size can be controlled by varying some of the input requirements. For example, the air stream remains constant with a constant pressure air inlet. Secondly, the fluid flow rate can be varied to change the delivered flow and the pressure required for the nozzle flow. This device may be used in conjunction with a pump, a gravity feed system or other flow pressure device. Additionally, the inlet fluid may be continuous or pulsed while the energy of the outlet stream may be varied by changing the inlet air pressure. The fluid outlet serration pattern is designed to provide even distribution of the fluid over a flat surface. Finally, the device is constructed in such a way that the serration pattern used on the dispersion part of the nozzle is designed so that the serrations are larger the further they are away from the nozzle centerline.

2. Description of the Prior Art

Conventionally, dampener spray apparatus heretofore used in conjunction with lithographic printing presses have utilized the normal type of nozzle where air and dampening fluid are comingled in the interior of the nozzle and sprayed toward the dampening system. When this configuration is used, the configuration of the spray can generally be described as conical in shape so that a uniform deposition of spray on the dampening roll is virtually impossible. Examples of existing spray dampener apparatus may be seen by referring to U.S. Pat. Nos. 1,834,169; 3,924,531 and 4,044,674.

DESCRIPTION OF THE PREFERRED EMBODIMENT

Figure 1:
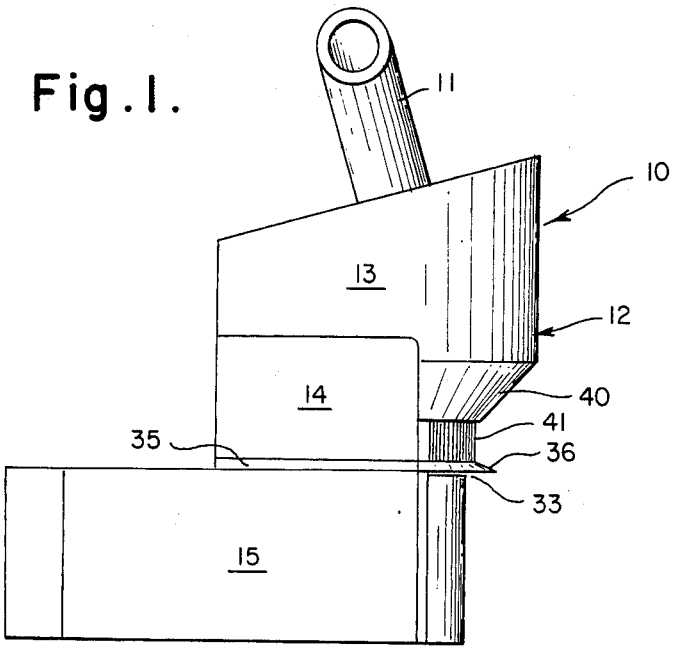
FIG. 1 is a side elevation of a dampener nozzle illustrating the modular construction.
Figure 2:
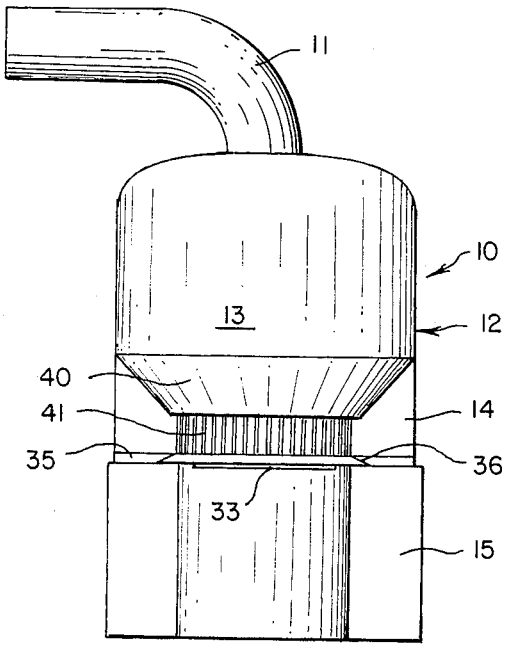
FIG. 2 is a front elevation of the nozzle of FIG. 1.
Figure 3:
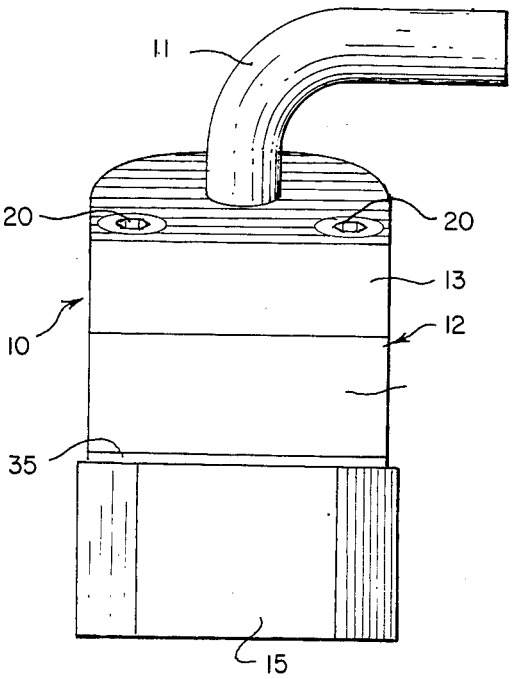
FIG. 3 is a rear elevation of the nozzle of FIG. 1.
Figure 4:
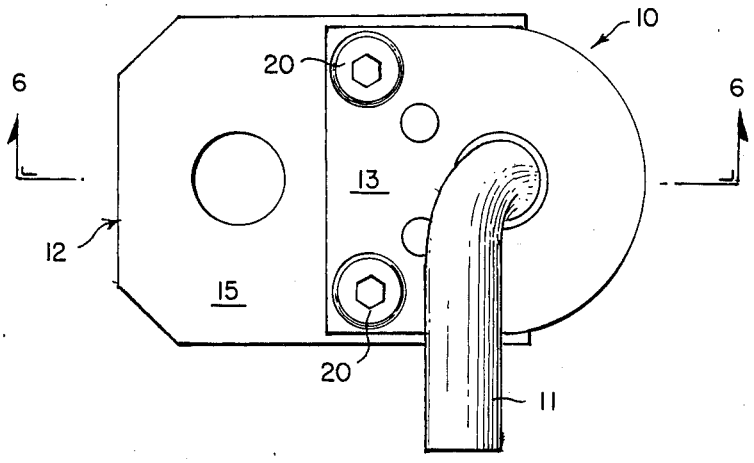
FIG. 4 is a top plane view of the nozzle of FIG. 1.

For a better understanding of the improved nozzle of this invention reference is made to the drawings and more particularly to FIGS. 1–3 of the drawings where the numeral 10 indicates the nozzle generally. Dampening fluid is introduced into nozzle 10 through a tube 11. Nozzle 10 is comprised of a body 12 constructed of a plurality of individual body parts. Specifically, body 12 includes an upper modular body part 13, an intermediate modular body part 14 and a lower body part 15. These individual parts, 13, 14 and 15, are joined together to form the nozzle body 12 by means of threaded fasteners such as machine screws 20 which join upper modular part 13 to intermediate modular part 14 and machine screws 21 which join intermediate modular part 14 to the lower modular body part 15. Obviously, other or alternative fastening means may be used to join the individual modular parts together to produce a unitary structure.

Figure 6:
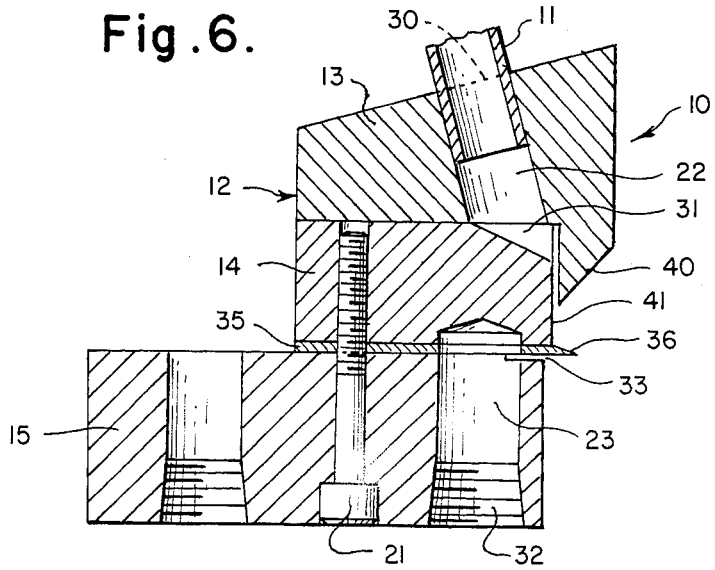
FIG. 6 is a cross-sectional view showing the modular components and fluid flow passages of the nozzle of this invention.

Means are provided in the modular parts 13, 14 and 15 to define passages 22 and 23 that conduct streams of dampening fluid and air, respectively, between inlet and outlet orifices. Passage 22 has an inlet orifice 30 at the upper end whereby tube 11 is inserted into the opening of passage 22 and an outlet orifice 31 where passage 22 terminates in the cut out portion formed on the upper right hand corner of intermediate modular part 14, as shown in FIG. 6. Passage 23 extends upwardly through the lower modular body part 15 from inlet orifice 32 toward an outlet orifice 33 that directs air coming through passage 23 outwardly away from the nozzle 10.

Figure 5:
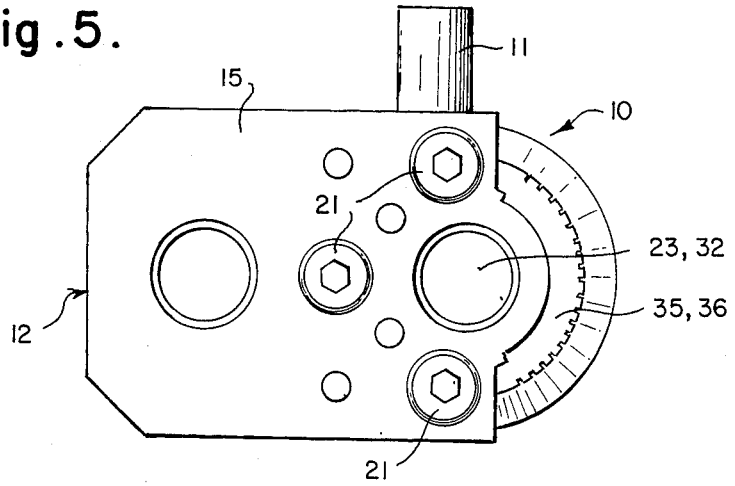
FIG. 5 is a bottom elevation of the nozzle of FIG. 1.

Again, referring to FIG. 6, it can be seen that there is provided between the lower modular part 15 and the intermediate modular part 14, deflector means in the form of a deflector plate 35. Plate 35 is held in position by the machine screws 21 which join the intermediate body 14 to the lower body 15. Deflector plate 35 is mounted to provide a lip portion 36 that extends outwardly beyond the outermost surfaces of modular parts 13 and 15 to intersect the fluid streams exiting from outlet orifices 31 and 33. The lip portion 36 decreases in thickness from a point adjacent the outer surfaces of the modular parts 13 and 15 to the outer edge thereof and has its upper surface formed with striations, as shown in FIG. 5.

Outlet orifice 31 is defined by the material removed from the corner of intermediate module 14 (referred to above) an overhanging, dependent portion 40 formed as part of upper module 13 and the outer surface 41 of intermediate module 14. Thus, the direction of flow of dampening fluid from orifice 31 is vertically downwardly along the outer surface 41 toward the lip 36 and air outlet orifice 31, orifice 31 being disposed at essentially right angles with respect to orifice 33. It should be pointed out that the outer surface 41 of module 14 is arcuate in configuration and is striated in the direction perpendicular to the direction of curvature of the arc of face 41.

The nozzle 10 of this invention acts in a manner that causes a change in the direction of flow of one of the fluid streams, specifically the dampening fluid stream, to create a widely dispersed laminar spray pattern. The provision of deflector plate 35 accomplishes several desirable results, namely, it reduces outlet air turbulence to thereby increase the horizontal spray angle and simultaneously decrease spray droplet size to be varied by changing inlet air pressure.

In operation, compressed air enters inlet orifice 32 and is directed through passage 23 to the narrow slot that defines the outlet orifice 33. Simultaneously, dampening fluid enters inlet orifice 30 through tube 11 and inlet orifice 30 and exits outlet orifice 31 between overhang portion 40 and face 41. The dampening fluid then impinges against the striated upper surface of lip portion 36 of deflector plate 33 where its direction of flow is caused to become substantially identical to that of the air from outlet 33. When the dampening fluid and air streams are shaped in this manner it is possible to produce a wide angular dispersion in a horizontal direction while severely limiting the depth of the spray pattern in a vertical direction.

While the present invention has been described in connection with a preferred embodiment, it is to be understood that modifications and changes can be made within the purview and scope of the appended claims without departing from the true scope and spirit of the invention.

I claim:

1. A spray nozzle for applying dampening fluid to a printing press, said nozzle comprising:

a. a nozzle body constructed of upper, intermediate and lower modular body parts;

b. means defining a passage for conducting a stream of dampening fluid betwen an inlet orifice in said upper body part and an outlet orifice directing the flow of dampening fluid along the outer surface of said intermediate body in a first direction;

c. means defining a passage for conducting a stream of air through said lower body part to an outlet directing the flow of air in a second direction that is substantially at right angles to said first direction flow of the dampening fluid; and deflector means secured between said intermediate and lower body parts and extending outwardly therefrom to define a deflector lip that separates the fluid streams and changes the said first direction of flow of the dampening fluid to said second direction before the dampening fluid and air streams meet.

2. A spray nozzle as defined in claim 1 wherein said outer surface of said intermediate body part is arcuate and striated in the direction perpendicular curvature of the arc.

3. A spray nozzle as defined in claim 2 wherein a lip portion of said deflector extends outwardly beyond said curved outer surface of said intermediate portion.

4. A spray nozzle as defined in claim 3 wherein said lip portion curves to match the curvature of said intermediate past outer surface, decreases in thickness from said outer surface to the outer edge and is striated on the upper surface thereof.

* * * * *